US006559582B2

(12) United States Patent
Miyamoto et al.

(10) Patent No.: US 6,559,582 B2
(45) Date of Patent: May 6, 2003

(54) CATHODE AND PROCESS FOR PRODUCING THE SAME

(75) Inventors: Hiroyuki Miyamoto, Kamifukuoka (JP); Misao Iseki, Kamifukuoka (JP); Manabu Arai, Kamifukuoka (JP); Hideaki Tamai, Kamifukuoka (JP); Chikao Kimura, Kamifukuoka (JP)

(73) Assignee: New Japan Radio Co., Ltd., Tokyo-to (JP)

( * ) Notice: Subject to any disclaimer, the term of this patent is extended or adjusted under 35 U.S.C. 154(b) by 0 days.

(21) Appl. No.: 09/971,226

(22) Filed: Oct. 3, 2001

(65) Prior Publication Data

US 2002/0024281 A1 Feb. 28, 2002

Related U.S. Application Data

(63) Continuation-in-part of application No. 09/934,212, filed on Aug. 21, 2001.

(30) Foreign Application Priority Data

Aug. 31, 2000 (JP) ..... 2000-262091

(51) Int. Cl.[7] ..... H01J 1/14

(52) U.S. Cl. ..... 313/346 R; 313/346 DC; 313/311; 313/352

(58) Field of Search ..... 313/346 R, 346 DC, 313/311, 310, 352

(56) References Cited

U.S. PATENT DOCUMENTS

| | | | | |
|---|---|---|---|---|
| 4,379,250 A | * | 4/1983 | Hosoki et al. | 250/423 F |
| 4,533,852 A | * | 8/1985 | Frank et al. | 313/292 |
| 5,507,675 A | * | 4/1996 | Frost | 313/346 DC |
| 6,190,579 B1 | * | 2/2001 | Billings | 252/515 |

* cited by examiner

*Primary Examiner*—Ashok Patel
(74) *Attorney, Agent, or Firm*—Ware, Fressola, Van Der Sluys & Adolphson LLP

(57) ABSTRACT

There is provided a cathode which is easily operable, harmless, and stable at high temperature at least 1,400° C. as well as excellent in electron emission characteristics at the same time, and the process for preparing the same. The cathode of the present invention comprises a polycrystalline substance or a polycrystalline porous substance of high-melting point metal material and an emitter material dispersed into said polycrystalline substance or polycrystalline porous substance in an amount of 0.1 to 30% by weight in the cathode, wherein the emitter material comprises at least one selected from the group consisting of hafnium oxide, zirconium oxide, lanthanum oxide, cerium oxide and titanium oxide.

6 Claims, 12 Drawing Sheets generation of hafnium oxide

CATHODE AND PROCESS FOR PRODUCING THE SAME

CROSS-REFERENCE TO RELATED APPLICATION

This is a continuation-in-part of application Ser. No. 09/934,212 filed on Aug. 21, 2001 pending.

BACKGROUND OF THE INVENTION

The present invention relates to a cathode operable at high temperature and a process for preparing the same. More specifically, the present invention relates to a cathode which is operable at higher temperature (for example, at least 1,400° C.) than the operational temperature for impregnated cathodes and which comprises environmentally safe material, and a process for preparing the same.

Conventionally, a cathode as shown in FIGS. 15(*a*) and (*b*) has been used for a medium to large electron tube such as a tube for huge power supply equipment. Meanwhile, a cathode shown in FIG. 15(*a*) has been generally used for a lamp of high power discharge tube, such as a source lamp for photolithography machines. These cathodes, operable even at high temperature of at least 1,400° C. where impregnated cathodes are inoperative, comprises a tungsten cathode 21 containing (about 2% by weight of) thorium oxide ($ThO_2$) (hereinafter referred to as thoriated cathode) which is connected to an electrode 20. Recently, impregnated cathodes are gradually applied for medium to large electron tube, since there are improvements in the degree of vacuum inside the tube and change in tube design based on environmental requirement. However, thoriated cathodes are the only practical cathode for the lamp of high power discharge tube, and cannot be easily replaced with the impregnated cathode.

Referring to the thoriated cathode, $ThO_2$ in tungsten W is deoxidized by tungsten or carbon C on the surface of the cathode at about 1,500 to 1,800° C., and a Th-W mono atomic layer is formed on the cathode surface. Thereby, work function of about 2.7 eV can be achieved, and electron emission characteristics of about 10 A/cm$^2$ can be obtained under vacuum of $10^{-5}$ Pa at 2,000° C. The fact indicates that the electron emission characteristics is improved by about 1,000 times or more as compared with tungsten cathodes (which have work function of about 4.5 eV). However, since $ThO_2$ contained in the thoriated cathode is a radioactive material, strict management is required for handling. Also, there are potential health and environmental problems. Along with recent environmental approaches, there is a tendency to restrict or stop the use of thorium mainly among its providers, i.e., European countries, indicating another possible problem of lack of stable supply in future.

In addition to the thoriated cathode and the tungsten cathode, there are cathodes having a construction shown in FIG. 16. These are used as high-intensity electron beam source for an electron beam photography machine of an electron microscope or ultra LSI micro processing. The cathode is operable at high temperature and constructed in a way that a lanthanum boride ($LaB_6$) cathode 22 is connected to electrodes 20. The cathode has metallic electrical conductivity and relatively low work function (2.68 eV). The electron emission characteristics of about 20 to 100 A/cm$^2$ can be obtained under vacuum of $10^{-5}$ Pa at operational temperature of 1,600° C. In addition, the cathode has relatively high ion bombardment resistance, and the original electron emission characteristics can be easily recovered even after exposure to atmosphere. However, since $LaB_6$ has monocrystal structure, it is necessary to select most appropriate (100) or (210) crystal plane to draw sufficient electron emission characteristics. Relatively speaking, life time of $LaB_6$ is as short as 500 to 2,000 hours. This is because problems still remain with respect to the stability of $LaB_6$ composition. In other words, though $LaB_6$ is far more stable than other rare earth borides (such as $YB_6$ and $GdB_6$), many report the problems with the stability of surface composition at high temperature. Thus, $LaB_6$ involves disadvantage in difficult handling due to the monocrystal structure and life time due to the stability of compound in itself.

Another but minor example is a zirconium-covered tungsten cathode 23 (monocrystal (100) plane) as shown in FIG. 17. This is partially used for an electron beam photolithography machine for the micro processing of ultra LSI. In the zirconium-covered tungsten cathode, zirconium hydride is thermally decomposed in vacuum and zirconium is adsorbed on the surface of tungsten. By introducing oxygen thereafter, electric dipole moment of a Zr—O—W layer 24 is formed on the surface. This enables to reduce work function to about 2.4 eV and excellent characteristics can be achieved. As a similar construction, development of Ti—O—W (monocrystal (100) plane) has been reported so far. It is said that the operational temperature is about 1,500° C. and life time thereof is 5,000 hours, while vacuum of at least $10^{-7}$ Pa is required. In any case, there are many problems such as selection of crystalline plane of tungsten monocrystal and practical reproducibility.

SUMMARY OF THE INVENTION

As mentioned above, the use of thoriated cathode operative at high temperature involves potential health and environmental problems since it contains radioactive materials. In addition, stable supply of the material is also at stake. On one hand, impregnated cathodes are generally not operable when the temperature is at least 1,400° C. And $LaB_6$ or zirconium-covered tungsten cathodes (monocrystal (100) plane) have, on the other hand, problems with handling difficulty such as plane direction adjustment, and stability.

The present invention has been carried out in order to solve the above problems. The object of the present invention is to provide a cathode which is easy to handle and harmless at the same time with a construction which is stable and capable of generating excellent electron emission characteristics even at high temperature of at least 1,400° C., and a process for preparing the same.

The cathode of the present invention comprises a polycrystalline substance or a polycrystalline porous substance of high-melting point metal and an emitter material dispersed into the polycrystalline substance or the polycrystalline porous substance in an amount of 0.1 to 30% by weight in the cathode, wherein the emitter material comprises at least one selected from the group consisting of hafnium oxide, zirconium oxide, lanthanum oxide, cerium oxide and titanium oxide.

By adopting this construction, a monatomic layer derived from hafnium oxide, zirconium oxide, lanthanum oxide, cerium oxide and titanium oxide (including Hf—W or the like without oxygen and Hf—O—W or the like through oxygen) is formed on the surface of high-melting point metal such as tungsten or molybdenum (Mo) at high operational temperature. The monatomic layer is relatively stable at high temperature, reduces work function, and serves as a cathode capable of generating excellent electron emission.

The high-melting point metal material is preferably alloy obtained by adding 0.01 to 1% by weight of Hf, Zr or Ti to tungsten or molybdenum. These added elements act as a reducing agent to improve reducing ability of the high-melting point metal element.

It is preferable to dispose a metal layer of at least one selected from the group consisting of iridium (Ir), ruthenium (Ru), osmium (Os) and rhenium (Re) at least on an electron emission surface of the polycrystalline substance or the polycrystalline porous substance. According to this, work function is further decreased.

It is also preferable to dispose a tungsten carbide layer or a molybdenum carbide layer at least on an electron emission surface of the polycrystalline substance or the polycrystalline porous substance. According to this, work function is further decreased.

Preferably, crystalline grains of the polycrystalline substance or the polycrystalline porous substance are structured fibrously in the same direction. According to this, toughness is improved and processing becomes easier. Furthermore, when carbonization takes place, a carbide layer is formed only on the outermost surface due to this high density construction.

In another embodiment of the present invention, a compound layer of at least one selected from the group consisting of hafnium tungstate, zirconium tungstate, lanthanum tungstate, cerium tungstate and titanium tungstate is disposed on an electron emission surface. According to this construction, hafnium tungstate, for example, will decompose to tungsten and hafnium oxide under cathode operating conditions of high temperature and vacuum. The thus obtained tungsten and hafnium oxide is excellent in homogeneity and reduction effect of tungsten proceeds smoothly, advantageously contributing to long life of the cathode.

The process for preparing a cathode of the present invention is a process in which an emitter material is dispersed in a polycrystalline substance or a polycrystalline porous substance of the high melting point metal material, and the process comprises using, as at least one component of the emitter material, a powdery compound of at least one selected from the group consisting of hafnium tungstate, zirconium tungstate, lanthanum tungstate, cerium tungstate and titanium tungstate. According to this, tungsten and an emitter made of oxide disperse uniformly, and the emitter material can be reduced smoothly.

Another process for preparing a cathode of the present invention comprises mixing, in water or an organic solvent, oxide powder of high-melting point metal material with oxide powder of at least one metal selected from the group consisting of Hf, Zr, La, Ce and Ti, and then calsining and sintering the mixture. According to this, the oxide of high-melting point metal is reduced, and then, it is possible to disperse an emitter material containing at least one selected from the group consisting of hafnium oxide, zirconium oxide, lanthanum oxide, cerium oxide and titanium oxide to the high-melting point metal material.

Another process for preparing a cathode of the present invention comprises mixing a solution obtained by dissolving, in water or an organic solvent, a nitrate of at least one metal selected from the group consisting of Hf, Zr, La, Ce and Ti with oxide powder of high-melting point metal material, and then calsining the mixture. According to this, the oxide of high-melting point metal is reduced and the nitrate is decomposed as well. And then, it is possible to disperse an emitter material containing at least one selected from the group consisting of hafnium oxide, zirconium oxide, lanthanum oxide, cerium oxide and titanium oxide to the high-melting point metal material.

Another process for preparing a cathode of the present invention comprises impregnating a solution obtained by dissolving, in an organic solvent, an alcoxide of at least one metal selected from the group consisting of Hf, Zr, La, Ce and Ti into a porous high-melting point metal material under reduced pressure, and then calsining the mixture. According to this, the alcoxide is decomposed, and then it is possible to disperse an emitter material containing at least one selected from the group consisting of hafnium oxide, zirconium oxide, lanthanum oxide, cerium oxide and titanium oxide to the porous, high-melting point metal material.

Another process for preparing a cathode of the present invention comprises covering, on powder of high-melting point metal, an alcoxide of at least one metal selected from the group consisting of Hf, Zr, La, Ce and Ti, and then calsining the mixture. According to this, the alcoxide is decomposed into an oxide, and the high-melting point metal powder covered with the oxide is formed. As a result, it is possible to disperse an emitter material containing at least one selected from the group consisting of hafnium oxide, zirconium oxide, lanthanum oxide, cerium oxide and titanium oxide to the high-melting point metal material.

It is preferable to pulverize a solid material formed by covering the oxide on powder of the high-melting point metal through the calsining step, to mix it with another powder of high-melting point metal, and then to sinter the mixture. According to this, mechanical strength of molded articles can be improved.

Preferably, the calsining/sintering step of the preparation process is carried out at temperature such that the emitter material is not deoxidized. According to this, it is possible to inhibit vain evaporation of the emitter material such as hafnium oxide and generation of final product.

Preferably, the above each process further comprises a step for drawing the high-melting point metal material, into which the emitter material is dispersed, by swaging in hydrogen gas. According to this, crystalline grains of the high-melting point metal can be structured fibrously in the same direction, and therefore, toughness is improved as well as excellent processability is achieved.

It is preferable to form a tungsten carbide layer or a molybdenum carbide layer at least on the electron emission surface of the cathode after fibrous structure is formed. According to this, a favorable construction can be obtained since carbonization takes place particularly only on the outermost surface not in the inside.

DETAILED DESCRIPTION

The cathode for high temperature operation and the process for preparing the same of the present invention are explained below with reference to the accompanied drawings.

Embodiment 1

Figure 1A:
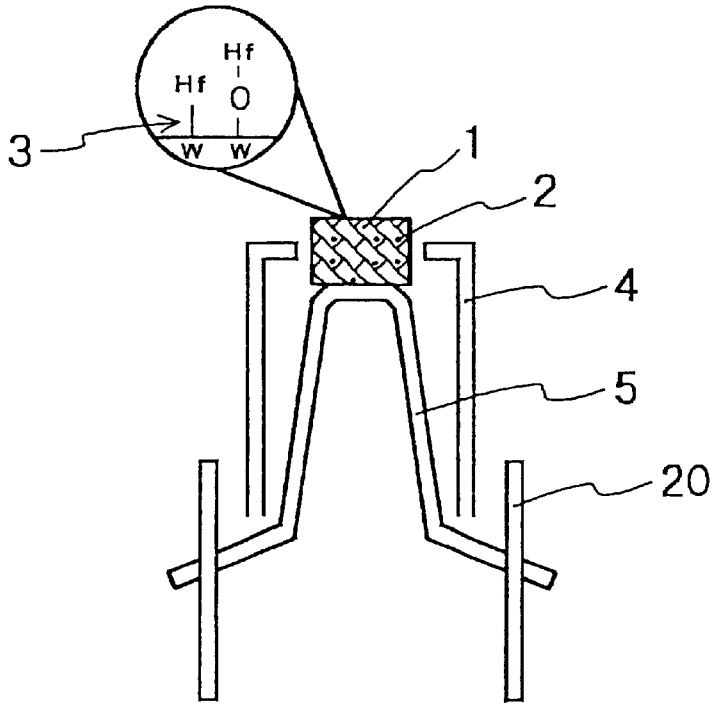
FIG. 1 is an explanatory view of a cathode according to Embodiment 1 of the present invention.
Figure 1B:
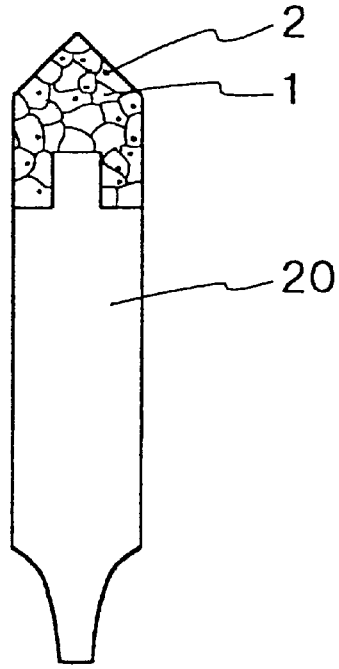

An embodiment of the cathode for high temperature operation according to the present invention is shown in FIGS. 1(*a*) and (*b*). FIGS. 1(*a*) and (*b*) are cross sectional views of a cathode for X-ray tube and for the lamp of high power discharge tube, respectively. Preferably, the cathode comprises a polycrystalline substance or a porous polycrystalline substance 1 of high-melting point metal material such as tungsten, and an emitter material 2 comprising at least one selected from the group consisting of hafnium oxide, zirconium oxide, lanthanum oxide, cerium oxide and titanium oxide is dispersed into the polycrystalline substance or a porous polycrystalline substance 1 in an amount of 0.1 to 30% by weight in the cathode. Or to the above emitter material 2 is added at least one selected from the group consisting of hafnium, zirconium, lanthanum, cerium and titanium. Numeral 4 indicates a cathode sleeve, numeral 5 a heater, and numeral 20 an electrode. FIG. 1 shows the case where the dispersion of the emitter material 2 into the polycrystalline substance 1 comprising the high-melting point metal material is carried out by mixing high-melting point metal material powder with emitter material powder.

The high-melting point metal material of the present invention has a melting point of at least 2500° C. Examples thereof are tungsten (W), and molybdenum (Mo) from the viewpoint of optimum reducing agents, large drawing strength, and low vapor pressure.

The emitter material 2 is dispersed into the polycrystalline substance or the porous polycrystalline substance 1 comprising the high-melting point metal material. The emitter material 2 comprises at least one selected from the group consisting of hafnium oxide, zirconium oxide, lanthanum oxide, cerium oxide and titanium oxide and is dispersed in an amount of 0.1 to 30% by weight into the polycrystalline substance, or preferably 20% by weight of the porous crystalline substance. When the amount of the above oxide is less than 0.1% by weight, the sufficient emission characteristic can not be achieved for instability formation of mono atomic layer on cathode surface. When it is more than 30% by weight, the mechanical strength decline or the large amount of emitter evaporation stain in tube. Among the above oxides, hafnium oxide and zirconium oxide are preferably used from the viewpoint of realization of the highest temperature operable cathode due to low vapor pressure.

A preferable cathode is such that at least one selected from the group consisting of hafnium (Hf), zirconium (Zr), lanthanum (La), cerium (Ce) and titanium (Ti) is further mixed to the emitter material. Among these, Hf and Zr are preferable from the viewpoint of strong reducing and low vapor pressure. The amount is preferably 0.01 to 1% by weight, more preferably 0.1 to 1% by weight. When the amount added to the emitter material 2 is less than 0.01% by weight, it is possible to ignore the effect of emission improvement. When it is more than 1% by weight, the amount of emitter evaporation tends to increase.

Also, alloy having about 0.01 to 1% by weight of Hf, Zr or Ti is preferably added to the high-melting point metal material as a reducing agent, since reduction performance can be further improved. When the amount is less than 0.01% by weight, reduction performance can not be improved by little enough. When it is more than 1% by weight, it is difficult to produce. As the reducing agent, Hf and Zrare particularly preferable from the viewpoint of strong reduction and low vapor pressure.

Figure 2:
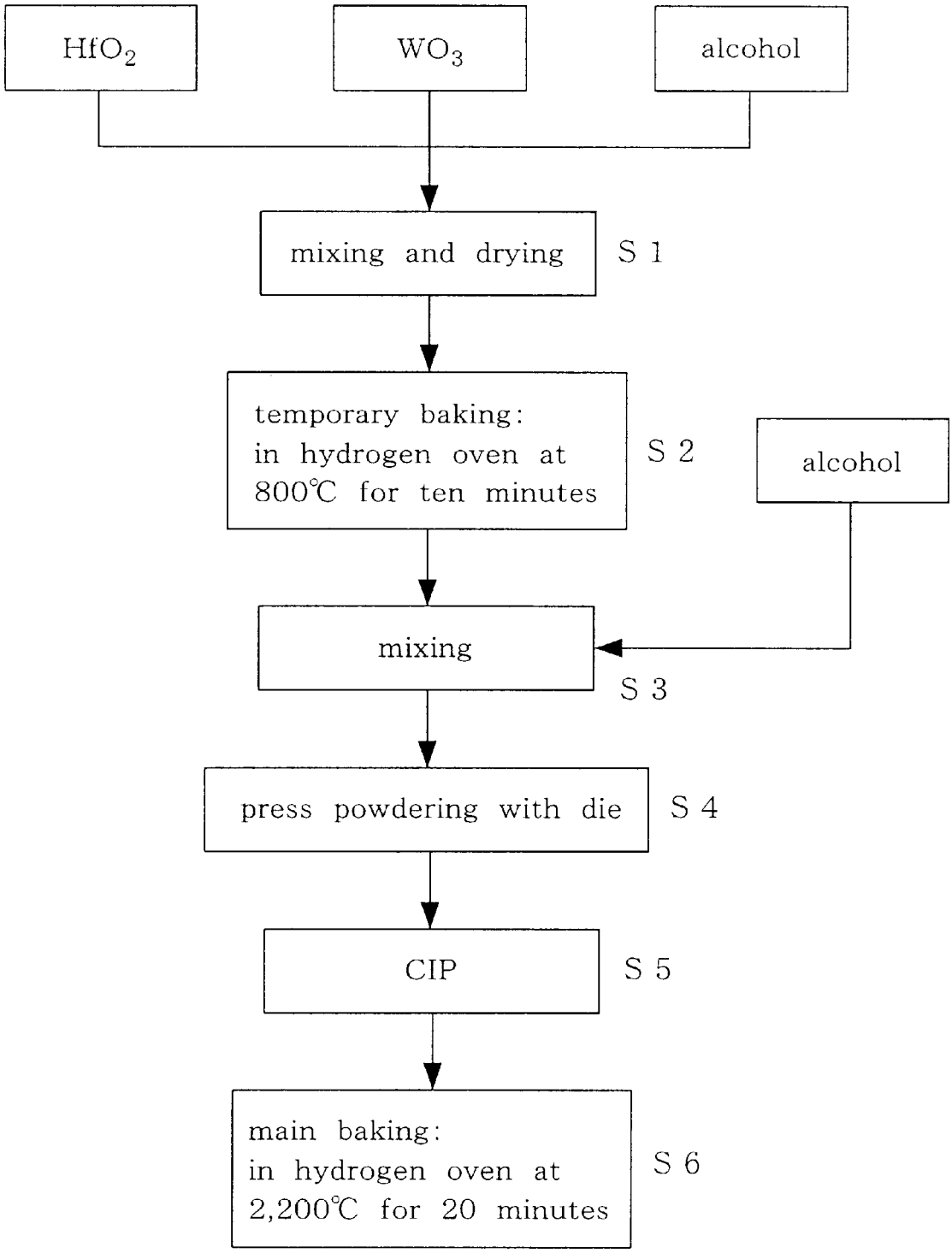
FIG. 2 is a flow chart illustrating a process for preparing the cathode shown in FIG. 1.

In order to prepare the cathode of the present invention, tungsten oxide $WO_3$ powder is mixed with hafnium oxide $HfO_2$ powder in alcohol and the mixture is dried (S1) as exemplified by the flow chart in FIG. 2. The alcohol lowers surface energy of the grains and prevents grains from cohesion with each other to achieve homogeneous mixing. Another organic solvent or water can be also used instead of alcohol. The organic solvent, however, is more preferable since it is easily dried. As the mixing process, substance to be mixed is added in equal amount all the time, for example, in such a way that tungsten oxide powder and hafnium oxide powder are mixed with each other in the same amounts at first, and then tungsten oxide powder is further added in the same amount as the mixture. According to this, a homogeneous mixture can be obtained and a property of cathodes, i.e., reproducibility can be improved even when the amount of hafnium oxide is as small as 1% by weight.

Next, calsining process is carried out in a hydrogen oven of about 800° C. for about 10 minutes to reduce tungsten oxide. Then mixed powder of tungsten fine powder and hafnium oxide fine powder having particle size of about 0.1 to 1 $\mu$m is prepared (S2). After mixing the mixed powder sufficiently in alcohol (S3), the powder is pressed into tablets by using a die (S4), and a cathode of desired shape is formed by CIP (cold isostatic pressing) (S5).

Finally, a cathode is formed by thermal treatment in a hydrogen oven of at least 1,800° C. (S6). The thermal treatment is performed for the purpose of sintering tungsten (restructuring grain boundaries) and improving mechanical strength, preferably at temperature such that an emitter material is not reduced and the cathode is not activated. That is, treatments were performed at 2,200° C. for 20 minutes in this embodiment where hafnium oxide is used. According to this, it is possible to inhibit vain evaporation of hafnium oxide and generation of final products. Meanwhile, generation and incorporation of Hf and the like in this process may not cause any problem.

In the embodiment of FIG. 2, molybdenum oxide can be also used instead of tungsten oxide $WO_3$. Also, by using tungsten powder or molybdenum powder to which Hf, Zr or Ti is added, it is possible to obtain a cathode such that an emitter material is dispersed into tungsten alloy or molybdenum alloy containing Hf, Zr or Ti.

Figure 3:
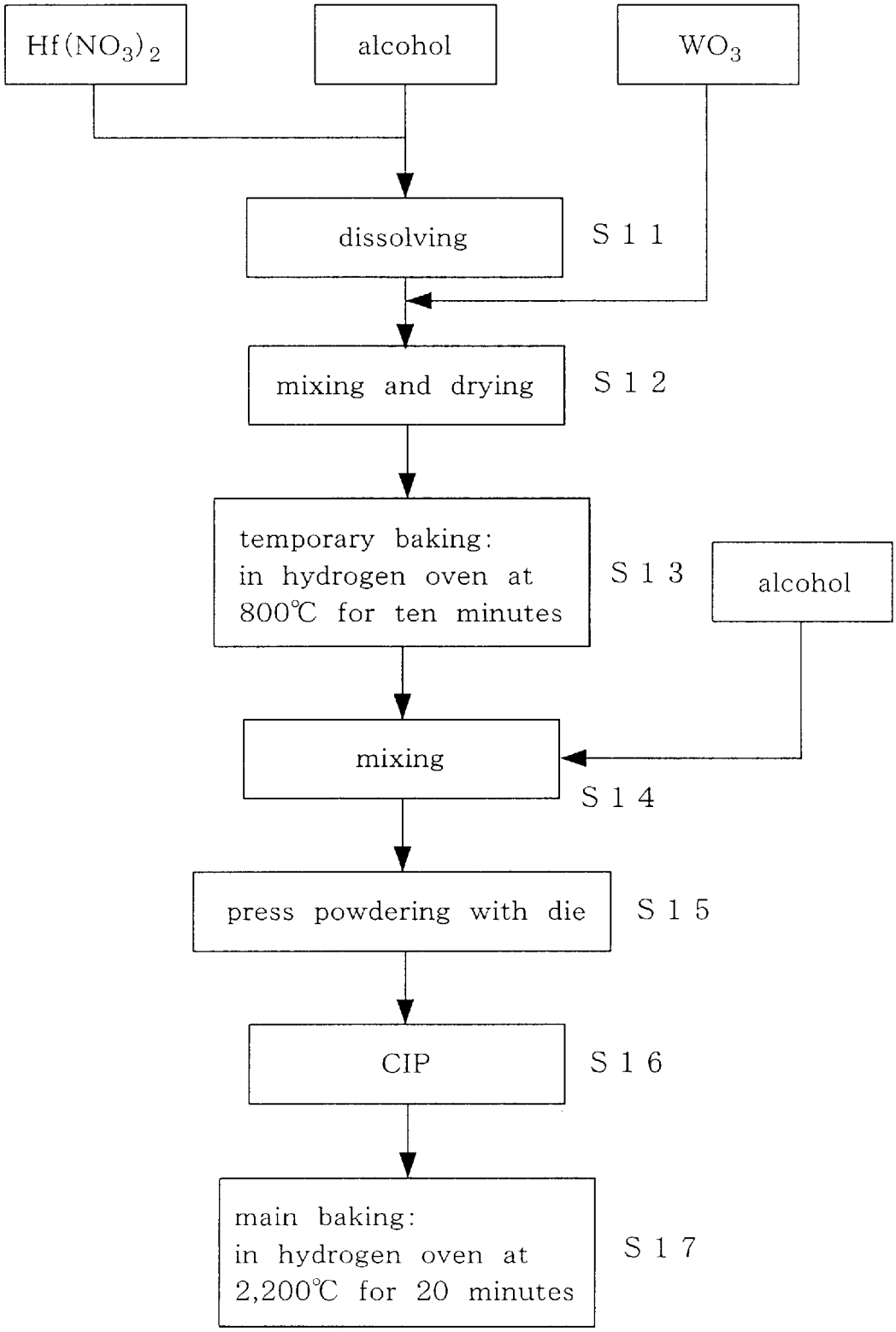
FIG. 3 is a flow chart illustrating another process for preparing the cathode shown in FIG. 1.

Alternatively, the above process for preparing a cathode by mixing tungsten oxide powder with an emitter material can be also carried out by the steps shown in FIG. 3. Specifically, a solution in which hafnium nitrate $(Hf(NO_3))_2$ is dissolved in alcohol is prepared (S11) at first. Another organic solvent or water can be also used instead of alcohol in this case alike. Tungsten oxide ($WO_3$) powder is added to the solution, and the mixture is sufficiently mixed and dried (S12). As a next step, calsining process is carried out in a hydrogen oven at 800° C. for about 10 minutes (S13). Herein, tungsten oxide is reduced, and hafnium nitrate is thermally decomposed to obtain mixed powder of tungsten fine powder and hafnium oxide fine powder. Thereafter, sufficient mixing is performed again in alcohol (S14).

Then, the mixed powder is pressed into tablet (S15) and treated by CIP (cold isostatic pressing) (S16) to prepare a cathode having a desired shape. Finally, a cathode is obtained by thermal treatment in a hydrogen oven of at least 1,800° C. for about 20 minutes (S17). Similarly to the above, the thermal treatment is performed preferably at temperature such that an emitter material is not reduced and a cathode is not activated. According to this, it is possible to inhibit vain evaporation of hafnium oxide and generation of final products. According to this process, it is possible to obtain a cathode in which an emitter material is dispersed more homogeneously.

Generation and incorporation of Hf and the like during this process may not cause any problems in this case alike. Molybdenum oxide can be also used instead of tungsten oxide ($WO_3$). Also, by using tungsten powder or molybdenum powder to which Hf, Zr or Ti is added, it is possible to obtain a cathode wherein an emitter material is dispersed into tungsten alloy or molybdenum alloy containing Hf, Zr or Ti.

The thus obtained cathode of the present invention is attached to an electron tube or a discharge tube lump by connecting the cathode with a heater 5 and electrodes 20 as shown in FIGS. 1(*a*) and (*b*). In operation, the cathode is once activated at about 2,400° C. by electrity the heater 5, and then the temperature of the cathode is set to about 2,400° C. According to this, hafnium oxide reduced by tungsten forms the monatomic layer 3 of hafnium or hafnium through oxygen, i.e., hafnium oxide (Hf—W layer or Hf—O—W layer) on the cathode surface, and work function can be decreased. As a result, electron emission characteristic of about 0.5 A/cm$^2$ at 1,800° C. was achieved according to the cathode of the present invention. In case of the discharge tube lamp, glow discharge is provoked by inducing high-voltage pulse as a discharge trigger under xenon gas, for example, and is immediately transferred to arc discharge. The transition depends on plasma density derived from gas pressure of atmosphere or strength of electric field loaded on the cathode, and automatic transition is designed in the discharge tube lamp. As to the cathode at the time of arc discharge, a monatomic layer is formed on the cathode surface, electrons are emitted and arc discharge is maintained as is the case with the above.

Embodiment 2

Figure 4:
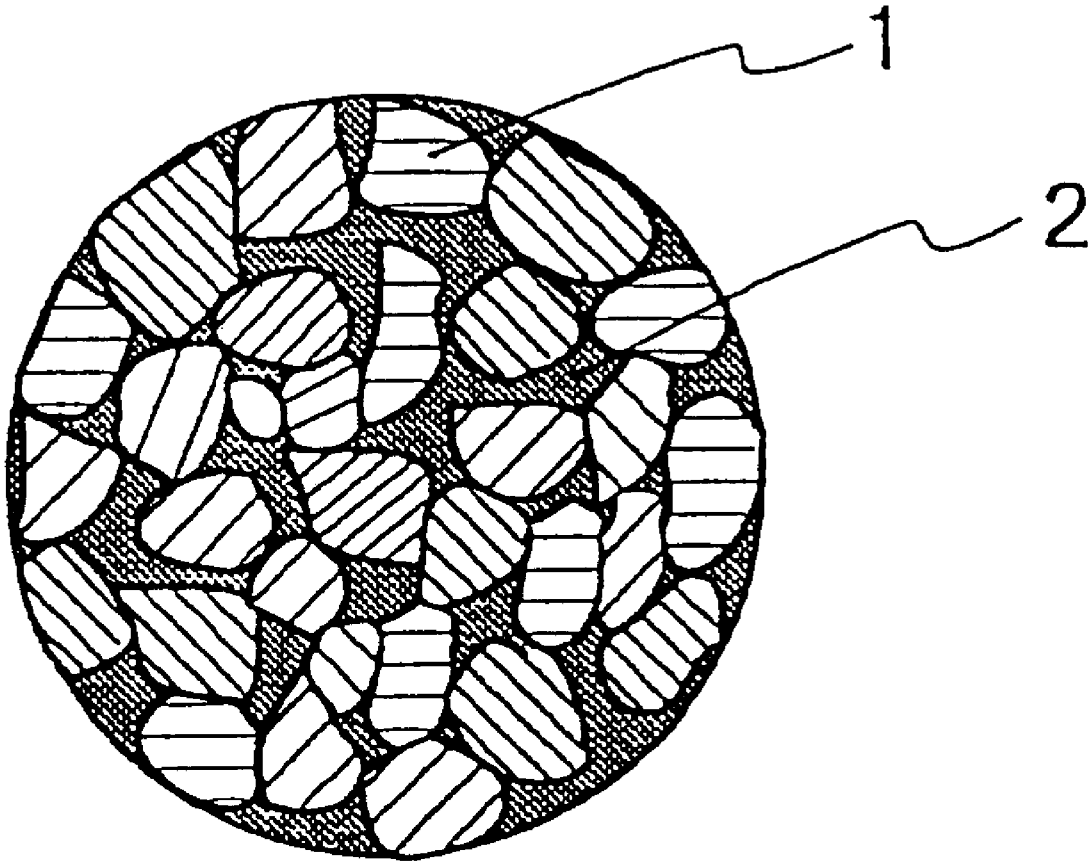
FIG. 4 is an explanatory section view of a cathode according to Embodiment 2 of the present invention.
Figure 5:
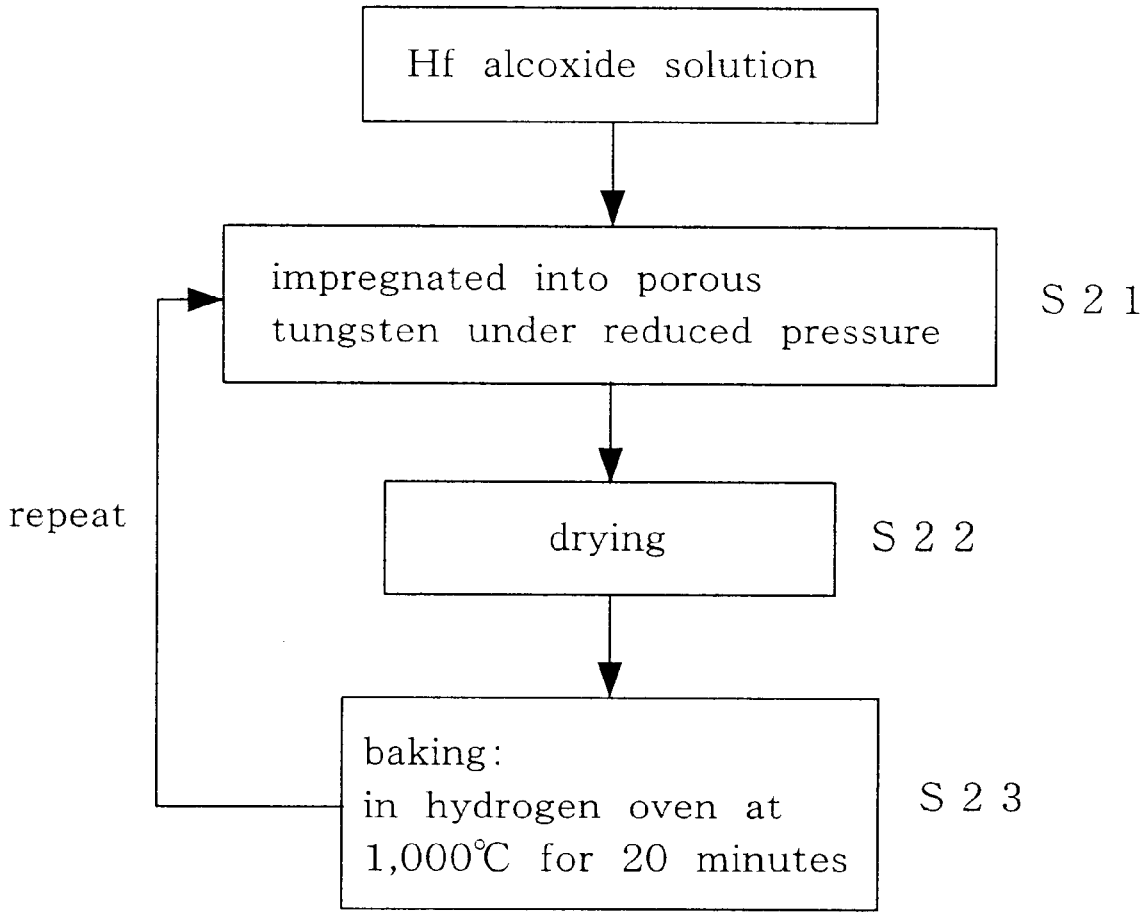
FIG. 5 is a flow chart illustrating a process for preparing the cathode shown in FIG. 4.

FIG. 4 shows another embodiment of the present invention in which dispersion of the emitter material 2 into the high-melting point metal material is carried out by impregnation of the emitter material 2 into the pores of the porous crystalline substance 1 of high-melting point metal material. In this case, hafnium oxide is impregnated into the pores of porous tungsten material (tungsten matrix). In order to prepare this cathode of the present invention, polycrystalline porous tungsten is formed by molding tungsten powder having particle diameter of, e.g., about 0.1 to 50 $\mu$m into desired cathode shape and by sintering the same at about 1,800 to 2,400° C.

Then, alcoxide solution of hafnium is put under reduced pressure where the degree of vacuum is $6.7\times10^3$ Pa. Under reduced pressure, a porous tungsten is immersed in the alcoxide solution in which alcoxide is dissolved in an organic solvent. By breaking the reduced pressure all at once, the alcoxide solution is impregnated into the porous tungsten (S21). Thereafter, by drying (S22) and calsining in an oven at 1,000° C. for about 20 minutes (S23), hafnium oxide is formed in the void of the porous substance. After that, by returning to the step S21 and repeating the subsequent impregnation, drying and calsining steps for about 10 times, the emitter material is sufficiently impregnated to the pores and a cathode having a construction shown in FIG. 4 can be prepared. According to this impregnation process, the emitter material need not undergo sintering temperature of as high as 2,000° C. Therefore, the emitter material is hardly deteriorated and has advantage in reproducing properties.

Generation and incorporation of Hf and the like during this process may not cause any problem in this case alike. Molybdenum oxide can be used instead of tungsten oxide. Also, by using tungsten powder or molybdenum powder to which Hf, Zr or Ti is added, it is possible to obtain a cathode in which an emitter material is dispersed into tungsten alloy or molybdenum alloy containing Hf, Zr or Ti.

Embodiment 3

Figure 6:
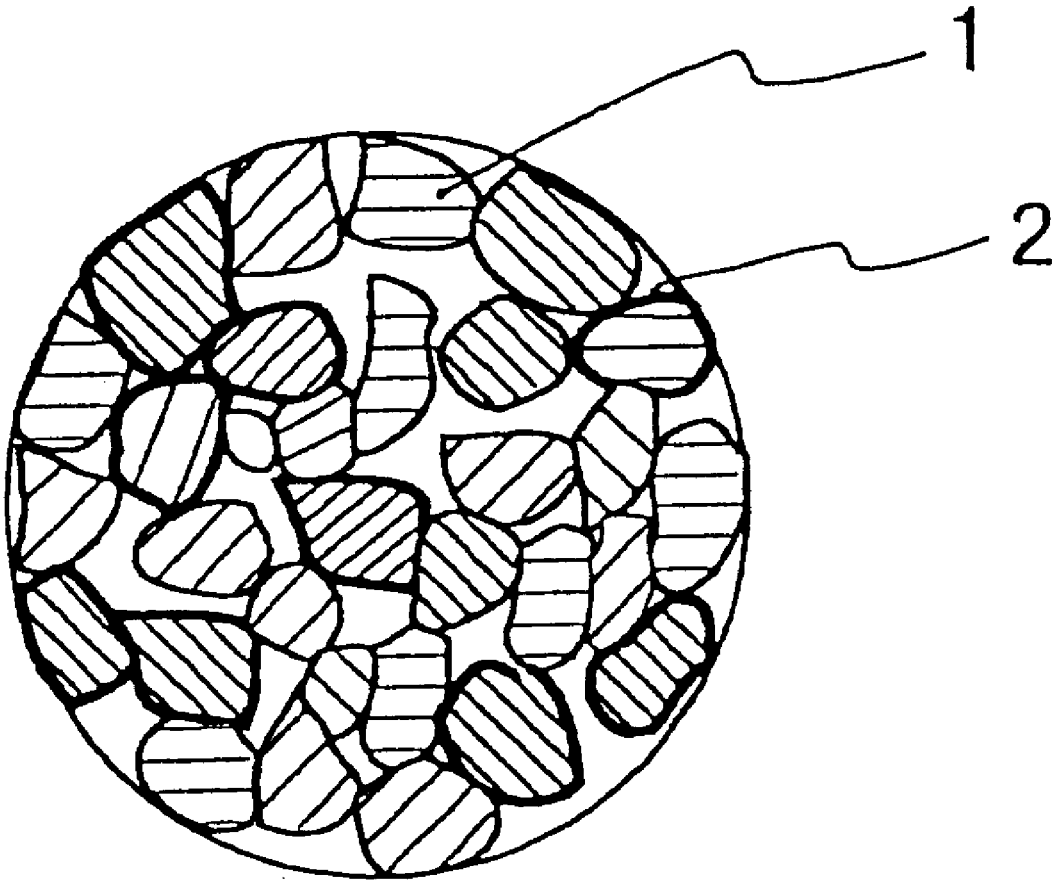
FIG. 6 is an explanatory section view of a cathode according to Embodiment 3 of the present invention.
Figure 7:
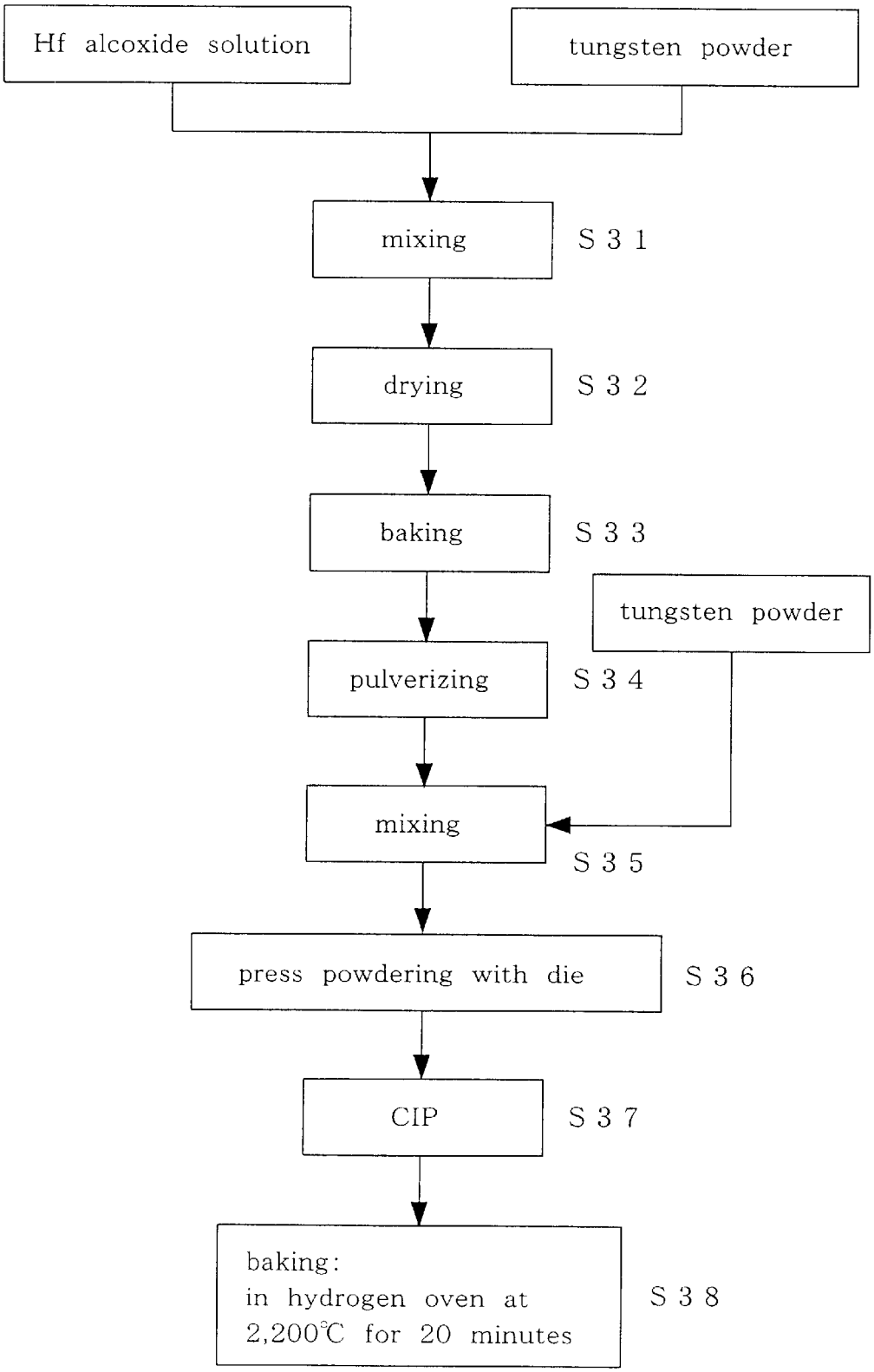
FIG. 7 is a flow chart illustrating a process for preparing the cathode shown in FIG. 6.

FIG. 6 is an explanatory sectional view showing another embodiment of the present invention. In this embodiment, a cathode is formed by dispersion of the emitter material 2 in which the grain boundaries of high-melting point metal powder comprising tungsten powder for example is coated with the emitter material 2 such as hafnium oxide, and by sintering the same. FIG. 7 shows the flow chart to prepare this cathode of the present invention. At first, tungsten powder having particle size of 0.1 to 1 $\mu$m is added to an alcoxide solution and mixing is carried out (S31). The mixture is dried (S32), calsined in a hydrogen oven at 1,000° C. for about 20 minutes (S33) and pulverized (S34) to obtain tungsten powder whose grain boundaries are coated with oxide hafnium. Then, additional tungsten powder is added thereto (S35), and the mixture was molded by pressing with a die (S36) and CIP (S37). Next, by performing sintering process in a hydrogen oven at 2,200° C. for about 20 minutes (S38), a cathode shown in FIG. 6 is obtained.

In the above embodiment, a new additional tungsten powder is added to the tungsten powder whose grain boundaries are coated with hafnium oxide at S35. It is preferable to mix additional tungsten powder freshly in this way, since mechanical strength of molded articles can be improved. The calsining step S33 may be directly followed by press powdering with a die (S36) (omitting S34 and S35). Even in this case, it is possible to obtain a cathode having a construction wherein the grain boundaries of the high-melting point metal powder are covered with the emitter material 2 such as hafnium oxide.

Embodiment 4

According to the above respective embodiments, cathodes excellent in electron emission characteristics can be obtained. On the other hand, work function can be further decreased and properties of cathodes are improved by depositing a metal layer of iridium (Ir), ruthenium (Ru), osmium (Os), rhenium (Re) and the like, or by forming a tungsten carbide layer ($W_2C$) or a molybdenum carbide layer ($MO_2C$) at least on an electron emission surface of the cathodes shown in FIGS. 1, 4 and 6. The thickness of the metal layer is preferable 0.01 to 0.5 $\mu$m. When it is smaller than 0.01 $\mu$m, it is difficult to deposit layer or control the thickness of layer. Even if it is larger than 0.5 $\mu$m, the effect of cathode improvement is saturated. The thickness of the carbide layer is preferably at most 20% the cathode thickness. When the carbide layer is thicker than the cathode layer by at least 20% the cathode thickness, mechanical strength of the cathode tends to be lowered.

Figure 8A:
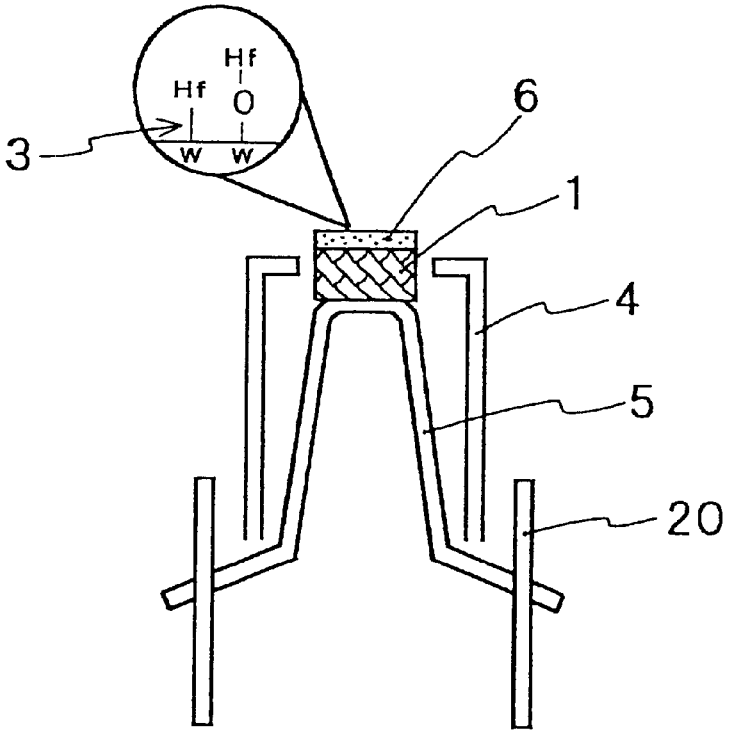
FIG. 8 is an explanatory section view of a cathode according to Embodiment 4 of the present invention.
Figure 8B:
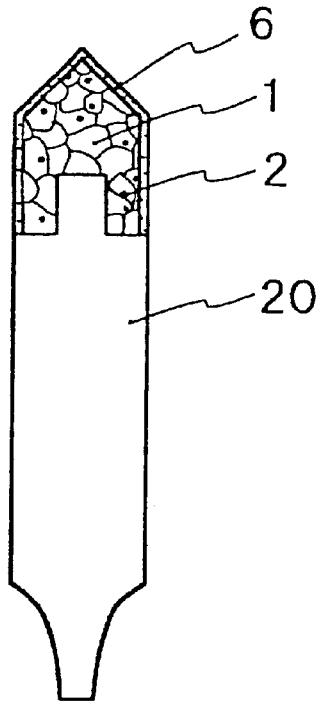
Figure 9:
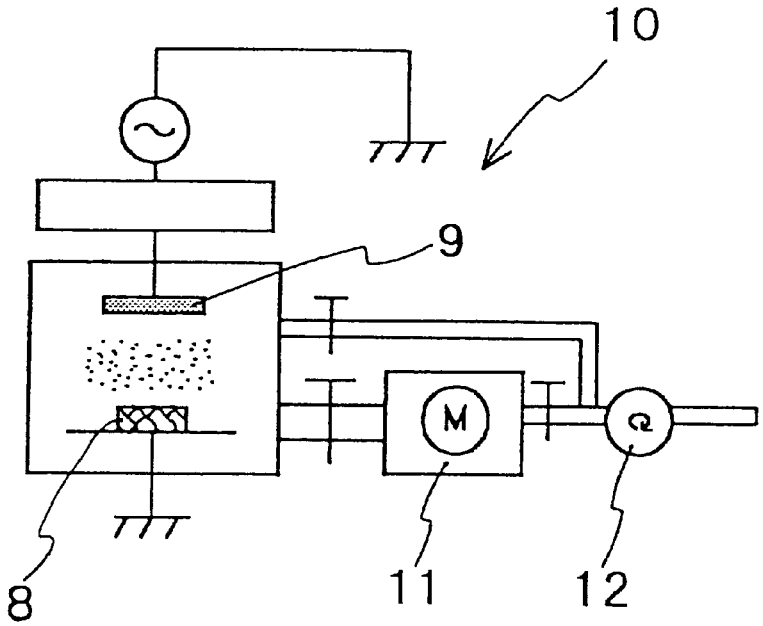
FIG. 9 is an illustration of an example of sputtering step for the cathode shown in FIG. 8.

FIGS. 8(*a*) and (*b*) show an embodiment in which an Ir layer 6 is deposited on a cathode surface. The cathode is attached to the same construction as that of the embodiment shown in FIG. 1. The Ir layer is formed by using, e.g., a sputtering apparatus 10 shown in FIG. 9. First, a cathode 8 is set in the sputtering apparatus 10. Under argon atmosphere of about $8.0\times10^{-1}$ Pa, RF output of 250 W is induced between a target 9 comprising Ir and the cathode 8 connected to an earth. By sputtering for about 30 minutes, an Ir layer 6 having thickness of about 300 nm is prepared. The deposition of the Ir layer 6 brings about decrease in work function by about 0.5 eV compared to the cathode construction shown in FIG. 1, and is effective for improving electron emission characteristics. In FIG. 8, the same parts as in FIG. 1 are identically numbered but explanation thereof is omitted. In FIG. 9, numeral 11 indicates a turbo-molecular pump for vacuum drawing and numeral 12 a rotary pump.

Though the Ir layer 6 is deposited on the cathode surface in the embodiment shown in FIG. 8, a layer of Ru, Os, Re or the like can also be formed instead of the Ir layer. Such a layer functions to decrease work function and improve electron emission characteristics similarly to the Ir layer. Also, the metal layer of Ir and the like can be formed by hydrolysis and calsining of metal alcoxide as well as by the sputtering method.

Embodiment 5

Figure 10:
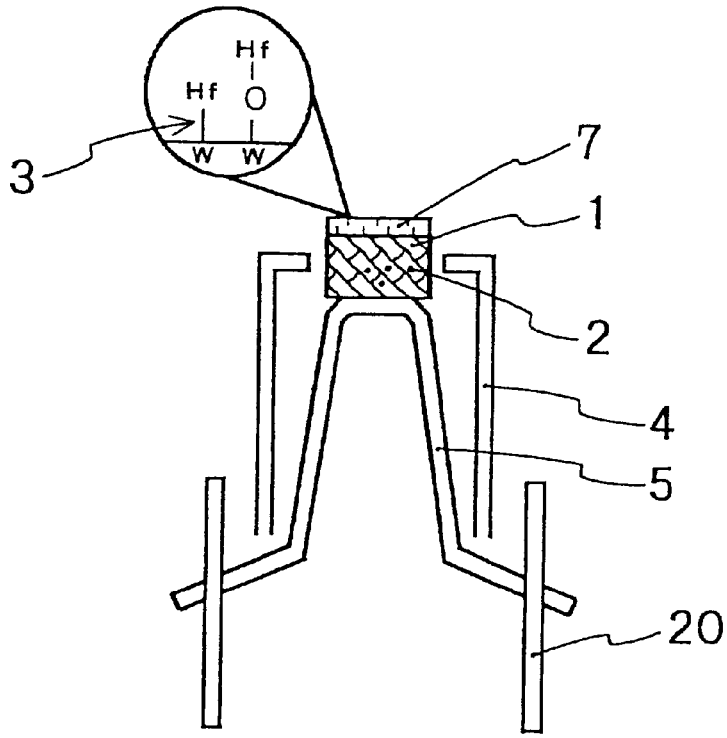
FIG. 10 is an explanatory section view of a cathode according to Embodiment 5 of the present invention.
Figure 11:
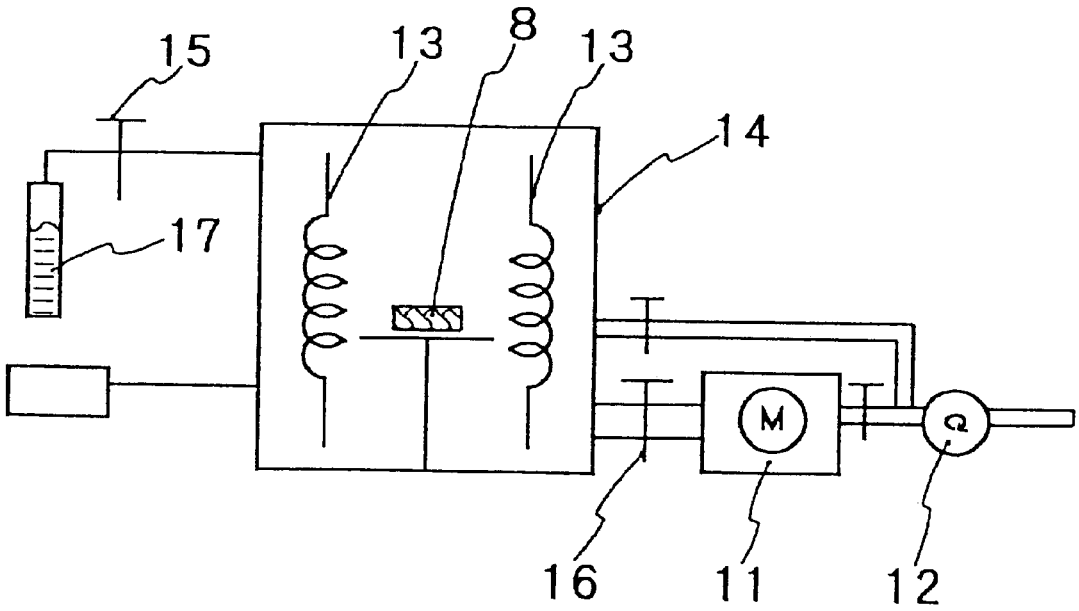
FIG. 11 is an illustration of an example of carbonization step for the cathode shown in FIG. 10.

FIG. 10 shows an embodiment in which a tungsten carbide ($W_2C$) layer 7 is formed on a cathode surface. The cathode is attached to the same construction as that of the embodiment shown in FIG. 1(*a*). The $W_2C$ layer 7 is formed, for example, by setting the cathode 8 at a given position inside a carbonization oven with a bell jar 14, and by carrying out the following steps. At first, evacuation of the bell jar is conducted to set the inner pressure to at most $133\times10^{-7}$ Pa. Then, heptane vapor is introduced to the bell jar from a heptane cylinder 17 gradually through a gas introduction valve 15 since the saturated vapor pressure of heptane is about $6.7\times10^{3}$ Pa at room temperature. In this case, a main valve 16 is suitably tightened to adjust the inner pressure of the bell jar to be stable at $6.7\times10^{-2}$ Pa.

Figure 12:
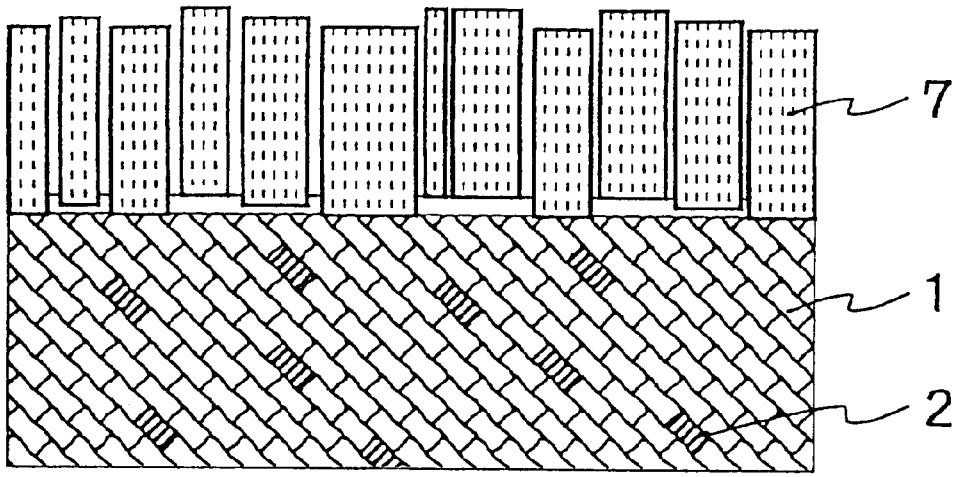
FIG. 12 is an enlarged view of the surface of the cathode shown in FIG. 10.

Thereafter, by heating the cathode 8 to 2,200° C. by using a heater 13 of carbonization oven, a $W_2C$ carbide layer 7 having thickness of about 15 $\mu$m is obtained in about five minutes (see FIG. 10). As magnified in FIG. 12, $W_2C$ forms columnar crystal. Therefore, minute cracks are generated on the surface. According to this, surface area of the cathode is enlarged, making it easier for hafnium oxide 2 to diffuse from the inside. When the pressure of heptane is at least $1.3\times10^{-1}$ Pa as the inner pressure of the bell jar, attention should be paid since a mixed carbide layer of WC and $W_2C$ is formed and columnar structure as shown in FIG. 12 cannot be obtained. As to the WC grain boundaries, crystals grow larger and it is difficult to achieve the state in which cathode surface areas are increased as shown in FIG. 12. Also, excessive carbonization causes to increase work function.

It is efficient to set the heating temperature to 2,100° C. to 2,450° C. for the purpose of forming a carbide layer. When the heating temperature is less than 2,100° C., the formation of the carbide layer takes much time. Furthermore, amorphous carbon is deposited on the cathode surface, carbon concentration is increased partially in some areas, and WC is formed. When it is more than 2,450° C., melting occurs due to eutectic temperature of W and $W_2C$.

In the same manner as the embodiment shown in FIG. 1(*a*), the cathode is attached to an electronic tube, and then by heating to about 2,400° C. to activate the cathode, the cathode surface is cleaned. Meanwhile, hafnium oxide is partially reduced to complete preparation for forming a monatomic layer. Herein, the role of $W_2C$ is to achieve reduction of hafnium oxide at lower temperature. Since reduction at operational temperature of 1,800° C. is accelerated compared to the case where $W_2C$ is not formed, there is an effect of improving electron emission characteristics. In other words, hafnium oxide is reduced by not only tungsten but also carbon, and therefore, supply of hafnium which forms a monatomic layer can be increased. The cathode is preferably used at actual operational temperature of 1,800° C. in view of life duration. As a consequence of forming the $W_2C$ layer on the cathode surface, electron emission characteristics of 0.3 A/cm$^2$ was increased to at least 5 A/cm$^2$ at 1,800° C. This carbonization also had inhibitory effect on evaporation of the emitter material.

Though a tungsten carbide layer was formed on the cathode surface in this embodiment, electron emission characteristics can also be improved by forming a molybdenum carbide layer instead of the tungsten carbide layer.

Embodiment 6

Figure 13:
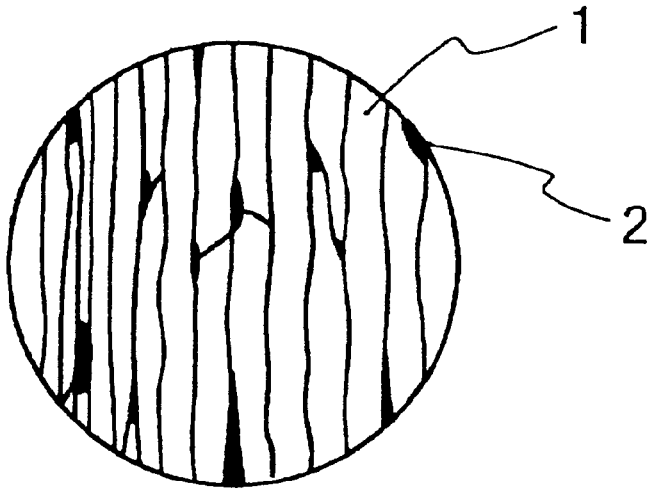
FIG. 13 is an explanatory section view of a cathode according to Embodiment 6 of the present invention.

FIG. 13 is a sectional construction view of a cathode according to another embodiment of the present invention. The figure shows the state where grain boundaries of tungsten are fibrously developed by swaging, at 1,500 to 1,800° C., of polycrystalline porous tungsten which is made bulk due to press powdering and sintering. According to this grain boundary structure, toughness is improved and processing becomes easier. Furthermore, when the cathode is carbonized, a carbide layer is ideally formed only on the outermost surface but not in the interior due to this high-density construction. Practically, the bulk polycrystalline porous tungsten is shaped into bars by swaging, and these tungsten bars are further processed into a cathode shown in FIGS. 1(*a*) and (*b*). It is possible to use molybdenum instead of tungsten in this embodiment.

Embodiment 7

Figure 14:
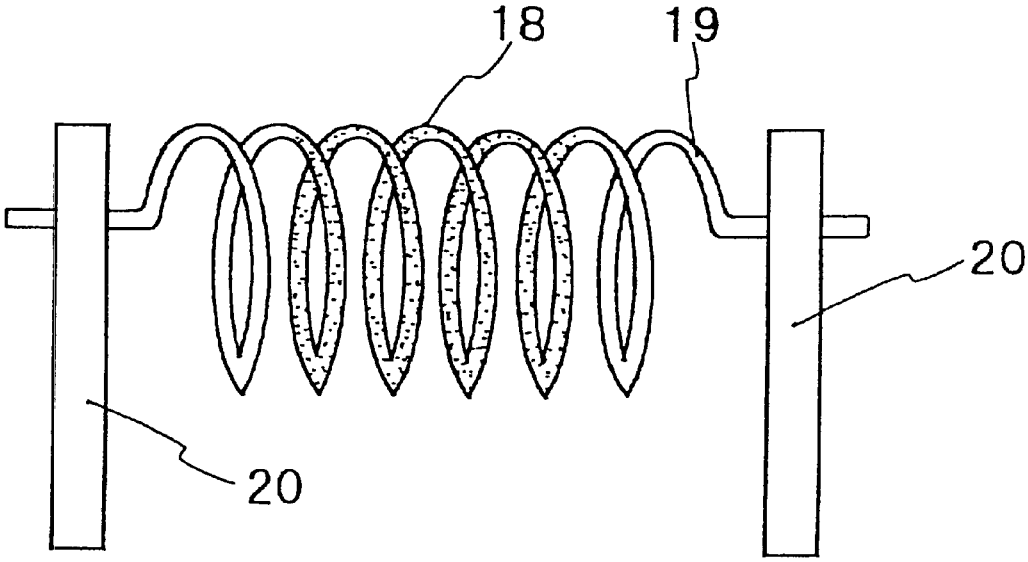
FIG. 14 is an explanatory view of a cathode according to Embodiment 7 of the present invention.
Figure 15A:
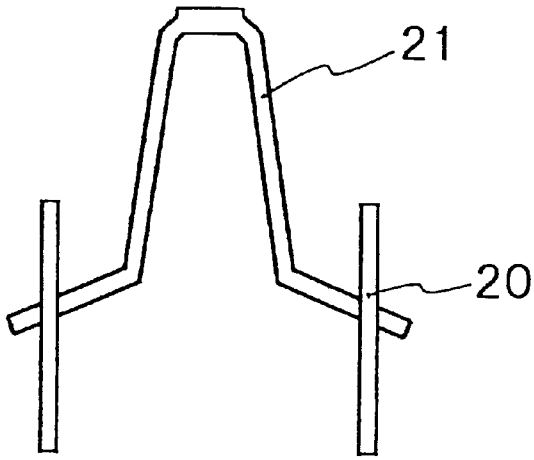
FIG. 15 is an explanatory view of a conventional thoriated cathode.
Figure 15B:
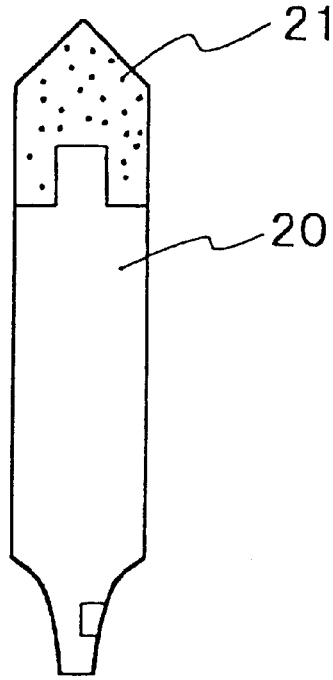
Figure 16:
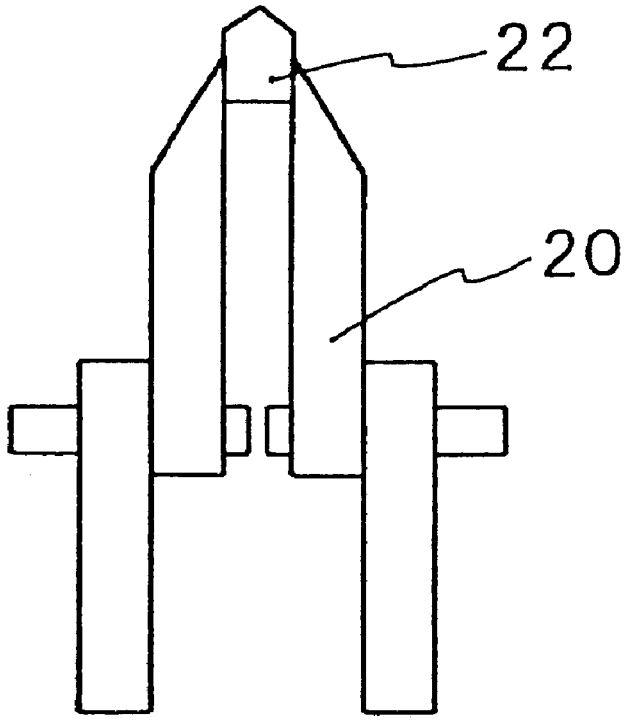
FIG. 16 is an explanatory section view showing a conventional $LaB_6$ cathode for a high-intensity electron beam source.
Figure 17:
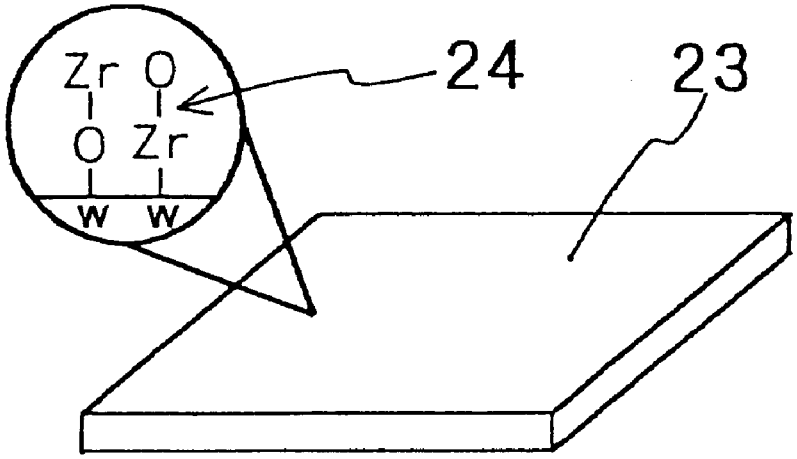
FIG. 17 is an explanatory view showing a conventional Zr-covered W cathode used for an electron beam photography machine for ultra LSI micro processing.

FIG. 14 is an illustration of a cathode according to another embodiment of the present invention. In this embodiment, hafnium tungstate powder is used as the emitter material, and the hafnium tungstate powder 18 is applied and fixed on a heater 19. Numeral 20 indicates electrodes. When the heater 19 is electrified in vacuum to operate the cathode, the hafnium tungstate 18 is thermally decomposed into tungsten and hafnium oxide. Hafnium oxide forms a monatomic layer on the surface of tungsten and excellent electron emission characteristics can be achieved as explained in the above embodiments. Herein, since the tungsten and the hafnium oxide are originally derived from a compound, their distribution is homogeneous in atomic level and electron emission characteristics are stable. Also, since the cathode can be formed by application of powder, this embodiment is effective for cathodes in which electrons need to be emitted from the surface of complicated shape.

The present invention has been described above by means of various embodiments, but the present invention is not limited thereto and can be modified in various ways. For example, though hafnium oxide was used as the emitter material in the above embodiments, useful emitter materials are any one or plural of zirconium oxide, lanthanum oxide, cerium oxide or titanium oxide, or those obtained by mixing any one or plural of hafnium, zirconium, lanthanum, cerium and titanium with these emitter materials.

Furthermore, as an initial material for the above emitter materials, hafnium tungstate, zirconium tungstate, lanthanum tungstate, cerium tungstate or titanium tungstate may be mixed into tungsten to prepare a cathode. In this case, the tungstate compounds are to be decomposed into tungsten and hafnium oxide, zirconium oxide, lanthanum oxide, cerium oxide, or titanium oxide under the cathode operational conditions of high temperature and vacuum. That is, when the formation of emitter material starts with a tungstate compound, reduction of the emitter material becomes smooth due to improved homogeneity with tungsten, showing effect on life duration, though the operational mechanism is the same as that of the above-mentioned cathode.

Also, the high-melting point metal may be an alloy obtained by adding 0.01 to 1% by weight of hafnium, zirconium or titanium to tungsten or molybdenum. When additives are introduced in this way, ability of reduction in touch with tungsten is improved and then the emitter material can be reduced even at lower temperature, contributing to monatomic layer formation.

In addition, though cathodes were shaped into tablet in the above embodiments, it is needless to say that the cathode shape may be linear or other various forms.

As described above, a cathode which is operable at high temperature of at least 1,400° C. where an impregnated cathode cannot be operated and which is far excellent in electron emission characteristics can be obtained according to the present invention. Besides, since hafnium oxide, zirconium oxide, lanthanum oxide, cerium oxide and titanium oxide, used as the emitter material have low vapor pressure and sufficient electron emission characteristics can be achieved, it is possible to prepare a cathode which does not evaporate at high temperature and has superior properties.

According to the process of the present invention, the high-melting point metal material and the emitter material disperse homogeneously, and therefore reduction of the emitter material proceeds smoothly. Furthermore, the swaging makes processing easier, and therefore, an ideal construction can be obtained after carbonization.

What is claimed is:

1. A cathode comprising a polycrystalline substance or a polycrystalline porous substance of high-melting point metal material and an emitter material dispersed into said polycrystalline substance or said polycrystalline porous substance, wherein crystalline grains of said polycrystalline substance or said polycrystalline porous substance are structured fibrously in the same direction, and wherein said emitted material comprises at least one selected from the group consisting of hafnium oxide, zirconium oxide, lanthanum oxide, cerium oxide and titanium oxide, and is dispersed in an amount of 0.1 to 30% by weight in said cathode.

2. The cathode of claim 1, wherein said emitter material contains at least one selected from the group consisting of hafnium, zirconium, lanthanum, cerium and titanium.

3. The cathode of claim 1, wherein said high-melting point metal material further comprising tungsten or molybdenum is an alloy obtained by adding 0.01 to 1% by weight of hafnium, zirconium or titanium to said tungsten or said molybdenum.

4. The cathode of claim 1, wherein a metal layer of at least one selected from the group consisting of iridium, ruthenium, osmium and rhenium is deposited at least on an electron emission surface of said polycrystalline substance or said polycrystalline porous substance.

5. The cathode of claim 1, wherein a tungsten carbide layer or a molybdenum carbide layer is formed at least on an electron emission surface of said polycrystalline substance or said polycrystalline porous substance.

6. The cathode of claim 1, wherein a compound layer of at least one selected from the group consisting of hafnium tungstate, zirconium tungstate, lanthanum tungstate, cerium tungstate and titanium tungstate is applied on an electron emission surface.

* * * * *